US007357065B2

(12) United States Patent
Mitsui

(10) Patent No.: US 7,357,065 B2
(45) Date of Patent: Apr. 15, 2008

(54) COMPOUND LINEAR MOTION AND ROTARY ACTUATOR

(75) Inventor: Kaichirou Mitsui, Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 257 days.

(21) Appl. No.: 11/342,538

(22) Filed: Jan. 31, 2006

(65) Prior Publication Data

US 2006/0222531 A1 Oct. 5, 2006

(30) Foreign Application Priority Data

Feb. 8, 2005 (JP) ..... 2005-031984

(51) Int. Cl.
*F15B 15/00* (2006.01)
*F01C 11/00* (2006.01)

(52) U.S. Cl. ..... 92/2; 92/31; 92/51; 92/116

(58) Field of Classification Search ..... 92/2, 92/31, 33, 51, 109, 116
See application file for complete search history.

(56) References Cited

U.S. PATENT DOCUMENTS 3,798,910 A * 3/1974 Bent ..... 92/2
3,973,468 A * 8/1976 Russell, Jr. ..... 92/2
3,989,223 A * 11/1976 Burkhardt et al. ..... 92/2
5,727,445 A 3/1998 Sheldon
6,247,390 B1 * 6/2001 Busch et al. ..... 92/33

FOREIGN PATENT DOCUMENTS

DE 19904942 8/2000
JP 8-8322 3/1996

* cited by examiner

*Primary Examiner*—Thomas E. Lazo
(74) *Attorney, Agent, or Firm*—Oblon, Spivak, McClelland, Maier & Neustadt, P.C.

(57) ABSTRACT

To eliminate necessity for rotating a rotation drive mechanism against frictional resistance originated by a sealing portion of a piston when an output shaft is rotated in a component linear motion and rotary actuator. An inside cylinder tube is concentrically provided in an outside cylinder tube and a piston that is driven by means of fluid pressure is fit into a cylinder chamber having a cylindrical shape formed between both the cylinder tubes in a manner so as to be slidable in an axial direction of the piston. A holder, which is rotatably supported by means of a bearing and which is capable of being rotated by means of rotation drive mechanism, is provided in the inside cylinder tube. An output shaft is inserted into the holder, in which the output shaft slides in the axial direction whereas the same does not rotate relative to the holder, and the output shaft is connected to the rod of the piston in a manner such that output shaft is rotatable by means of a bearing whereas the same integrally moves in the axial direction.

12 Claims, 2 Drawing Sheets

COMPOUND LINEAR MOTION AND ROTARY ACTUATOR

TECHNICAL FIELD

The present invention relates to a compound linear motion and rotary actuator capable of outputting compound motion in linear and rotary directions.

PRIOR ART

Hitherto, a compound linear motion and rotary actuator is known. The conventional compound actuator is constructed such that an actuator for a linear motion and that for a rotary motion are combined in a manner so as to construct an output shaft to be driven in a linear direction and a rotary direction at the same time. In the conventional compound actuator, a linear drive of the output shaft is performed by means of fluid pressure cylinder, and a rotary drive of the output shaft is transmitted to a spline shaft portion formed on a part of the output shaft via a spline nut from a rotation drive mechanism, as disclosed in a patent document 1, for example.

However, in this kind of the compound linear motion and rotary actuator including the one described in the aforementioned patent document 1, a piston in se rotates when rotation force is transmitted to the output shaft in general. Accordingly, even in a case when the output shaft is rotated, a rotation drive for rotating the rotation drive mechanism is necessary against a frictional resistance originated by a sealing portion of the piston. In general, although each of sealing members for sealing a portion for a linear motion and that for a rotary motion is required to be appropriately constructed for each of the linear motion and rotary motion, the above-mentioned sealing portion of the piston cannot be considered appropriate in light of sealing capability and a life thereof. This is because the above-mentioned sealing portion of the piston is caused to serve as a sealing function for both of the linear motion and the rotary motion. Such a problem is true not only for the sealing portion of the piston but also for the similar sealing member when provided on the output shaft or the like.

Further, in the compound actuator described in the aforementioned patent document 1, since a shaft having the spline and the piston is integrally formed, it requires trouble to divide the shaft into two and sandwich the piston between the shafts, or the like, when the compound actuator is manufactured. Furthermore, since the shaft having the spline penetrates a cylinder chamber, a sealing member that fits a shape of the cross-section of the spline is required in order to partition the cylinder chamber and ambient air portion, resulting in concern of possibility in escape of the fluid all the time. In addition, insufficient lubrication of a sliding bearing portion is concerned due to the pressurized fluid that moves in and out of the cylinder chamber during movement of the cylinder.

Japanese Unexamined Utility Model Registration Application Publication No. 8-8322

DISCLOSURE OF THE INVENTION

Accordingly, a technical problem of the present invention is to eliminate necessity of a rotation drive for rotating a rotation drive mechanism against a frictional resistance originated by a sealing portion of the piston, even when an output shaft of the above-described compound linear motion and rotary actuator is rotated.

Another technical problem of the present invention is to obtain a compound linear motion and rotary actuator which is not caused to serve as a sealing function for both of the linear motion and the rotary motion at a sealing portion of a piston or the like because of that the rotation force is not transmitted to the piston even when the rotation force is applied to the output shaft, and thereby the sealing function is fully achieved and the life thereof is elongated.

Still another problem of the present invention is to obtain a component linear motion and rotary actuator in which a rotation unit including a holder for rotating the output shaft is placed in ambient air pressure environment and thereby a spline for transmitting rotation from the holder to the output shaft is placed in the ambient air pressure environment as well, and in which lubrication of the sliding bearing can be stabilized for a long time.

In addition, still a further problem of the present invention is to obtain a component linear motion and rotary actuator in which the spline is not formed on a rod of the piston that moves in a reciprocating motion in a cylinder chamber and thereby a necessity of providing a sealing member fit for a shape of a cross-section of the spline is eliminated.

To solve the above-described problems, the present invention is characterized in providing a compound linear motion and rotary actuator, in which an inside cylinder tube is concentrically provided in an outside cylinder tube and a piston being driven by means of pressurized fluid is fit into a cylindrically shaped cylinder chamber formed between both of the inside cylinder tube and the outside cylinder tube in a manner so as to be slidable in an axial direction of the piston, and in which a holder being rotatably supported by means of a bearing in the inside cylinder tube and being caused to be capable of being rotated by means of a rotation drive mechanism is provided, and an output shaft is inserted into the holder, in which the output shaft slides in the axial direction whereas the output shaft does not rotate relative to the holder, and in which the output shaft is connected to a rod of the piston in a manner such that the output shaft integrally moves with the rod of the piston in the axial direction whereas the output shaft is rotatable relative to the rod of the piston by means of a bearing.

The present invention is characterized in providing the compound linear motion and rotary actuator, in which the holder and the output shaft are usually connected with each other by means of a spline nut fixed to the holder and a spline shaft portion formed on a part of the output shaft.

Further, the present invention is characterized in providing the compound linear motion and rotary actuator, in which all of the holder being rotatably supported by the bearing in the inside cylinder tube and the output shaft being inserted in the holder are disposed in an ambient air pressure environment.

According to the above-described compound linear motion and rotary actuator in the preferred embodiment of the present invention, the rotation drive mechanism for rotating the holder is provided in the outside cylinder tube or the inside cylinder tube, and the rotation drive mechanism is configured to have a transmission mechanism for transmitting a rotation of the rotation drive mechanism to the holder. Further, the rotation drive mechanism for rotating the holder is provided on the axial line of the output shaft so as to directly rotate the holder.

In the compound linear motion and rotary actuator having the above-described construction, the inside cylinder tube is concentrically provided in an outside cylinder tube and a linear motion unit is constructed by fitting a piston being driven by means of pressurized fluid into a cylindrically shaped cylinder chamber formed between both of the inside cylinder tube and the outside cylinder tube. On the other hand, a rotary unit is constructed by including the holder supported by means of the bearing in the aforementioned inside cylinder tube, a spline nut fixed to the holder, and the output shaft having a spline shaft portion to which rotation force is transmitted from the spline nut. Further, the holder of the rotary unit is rotatably supported by means of the bearing in the inside cylinder tube of the linear motion unit, and the output shaft having the spline shaft portion is rotatably connected to the rod of the piston by means of the bearing. Therefore, the rotation force of the output shaft is not transmitted to the piston and the piston performs only a reciprocating motion. On the contrary, friction originated by a sealing portion of the piston does not affect the output shaft as resistance as well.

Further, the rotary unit including the holder and the output shaft are configured to be always disposed in an ambient air pressure environment and thereby lubrication or the like for the sliding bearing of the output shaft is not affected by the ambient air pressure.

As described in detail above, in a component linear motion and rotary actuator according to the present invention, when the output shaft is rotated, it is not necessary to perform a rotation drive for a rotation drive mechanism against a frictional resistance originated by a sealing portion of the piston, and even when rotation force is applied to the output shaft, the rotation force is not transmitted to the piston. Thereby the sealing portion of the piston does not serve as a sealing function for both a linear motion and a rotary motion. Accordingly, the sealing function is fully achieved and the life of the compound linear motion and rotary actuator can be elongated. In addition, since a rotation unit including a holder for rotating the output shaft is placed in ambient air pressure environment, a construction of the component linear motion and rotary actuator can be simplified as a whole.

DETAILED DESCRIPTION

Figure 1:
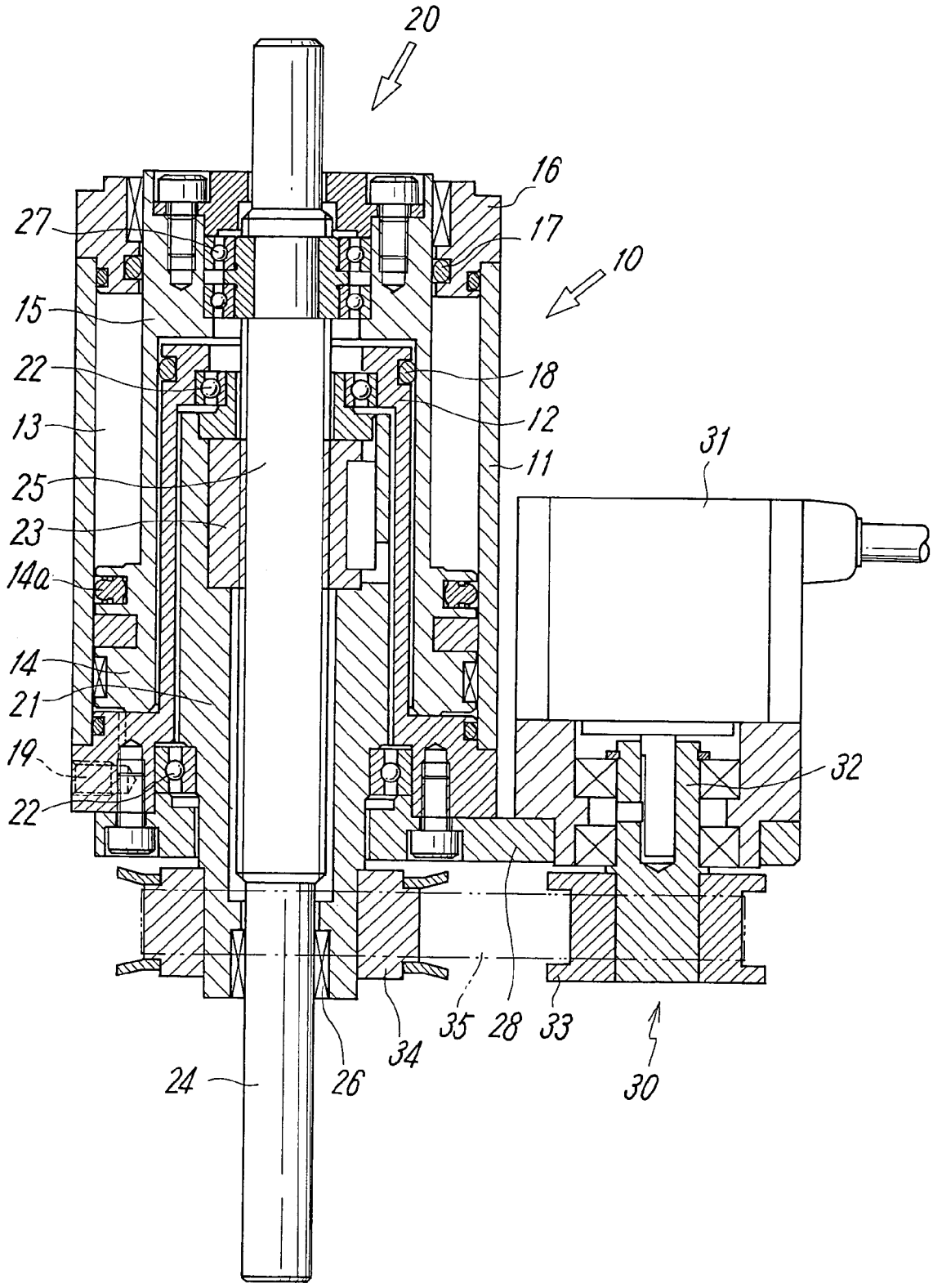
FIG. 1 is a cross-section illustrating a first embodiment of a component linear motion and rotary actuator in accordance with the present invention.

FIG. 1 illustrates a first embodiment of the component linear motion and rotary actuator with respect to the present invention. The component linear motion and rotary actuator of this embodiment is constructed by means of combining a linear motion unit 10 and a rotary unit 20 and schematically, the linear motion unit 10 is constructed by means of providing an inside cylinder tube 12 in an outside cylinder tube 11 in a concentric manner, and fitting a piston 14 to be driven by fluid pressure into a cylindrically shaped cylinder chamber 13, which is formed between both of the outside cylinder tube 11 and the inside cylinder tube 12. The aforementioned rotary unit 20 is provided with a holder 21 that is supported by a bearing 22 in the inside cylinder tube 12, a spline nut 23 fixed to the holder 21, and an output shaft 24 having a spline shaft portion 25 to which the rotation force is transmitted from the spline nut 23, and a rotation drive mechanism 30 is connected to the holder 21 for rotating the same.

More concretely explaining, the linear motion unit 10 connects the concentrically formed outside cylinder tube 11 and the inside cylinder tube 12 each other at a base end thereof, and forms a hollow cylindrically shaped cylinder chamber 13 between the above-mentioned cylinder tubes, 11 and 12, into which the piston 14 having a piston sealing portion 14*a* is fit. A rod 15 of the piston 14 has a cylindrical shape similar to the piston 14, and an outer face of a tip end of the rod 15 is sealed by means of a rod cover 16 at the outer cylindrical tube 11 with a sealing member 17 and at the same time, a sliding movement of the rod 15 is guided by the rod cover 16. Further, an internal surface of the piston rod 15 is sealed by means of interposing a sealing member 18 in between the inside cylinder tube 12 and the piston rod 15, and thereby the piston rod 15 is led through between the outside and inside cylinder tubes, 11 and 12, to an outer part.

Since the aforementioned piston 14 is driven by means of fluid pressure, a port 19 for feeding and discharging pressurized fluid such as compressed air or the like into one of pressure chambers that is formed by means of partitioning the cylinder chamber 13 by the piston 14 is provided in the base end portion of the inside cylinder tube 12. Although a port for feeding and discharging the pressurized fluid into the other pressure chamber partitioned by the piston 14 is not shown, the port can be provided in the rod cover 16 or the like when necessary, and a returning spring can also be housed in the pressure chamber at the rod cover 16 side of the piston.

On the other hand, the rotation unit 20 is provided with the holder 21 which is supported by a pair of the bearings, 22 and 22, in the inside cylinder tube 12 in a manner such that a rotational movement of the holder 21 is allowed whereas a movement thereof in an axial line direction is restrained. In addition, the spline nut 23 is fixed in the holder 21. Further, in the holder 21, the output shaft 24 having a spline shaft portion 25 to which the rotation force is transmitted from the spline nut 23 is provided. The output shaft 24 is supported by means of a sleeve 26 and is inserted into the holder 21 in a manner such that the output shaft 24 does not rotate relative to the holder 21 whereas a sliding movement in the axial line direction is allowed by means of the spline nut 23 and the spline shaft portion 25. In addition, the output shaft 24 is connected to the rod 15 of the piston 14 in a manner such that the output shaft 24 integrally moves with the rod 15 in the axial direction whereas the output shaft 24 is supported by means of a bearing 27 in a rotatable manner relative to the rod 15.

Further, the rotation drive mechanism 30 provided with a motor 31 for rotationally driving the holder 21 is supported by means of the inside cylinder tube 12, via a bracket 28 fixed to the inside cylinder tube 12. In addition, as a transmission mechanism for transmitting the rotation to the holder 21, a belt 35 is entrained about a pulley 33 that is fixed to a rotation shaft 32 of the motor 31 and a pulley 34 fixed to the portion of the holder 21, which is protruding from the inside cylinder tube 12. As the rotation drive mechanism 30 described above, it is not necessary to use the electric motor 31 and an appropriate device for performing the rotation drive can be employed. As for the transmission mechanism described above, an entraining transmission mechanism other than the pulley and the belt, a gear transmission mechanism, or the like can be used. Further, in the embodiment, shown in the figure, although the rotation drive mechanism 30 is constructed to be supported by means of the inside cylinder tube 12, the same can be supported by means of an appropriate fixed portion such as the outside cylinder tube 11 or the like.

In the component linear motion and rotary actuator having the aforementioned construction, when the piston 14 is driven in the axial line direction by means of feeding and discharging the pressurized fluid into the cylinder chamber 13 between the outside and inside cylinder tubes, 11 and 12, and the holder 21 is rotated by means of the drive of the electric motor 31, the rotation force is transmitted from the spline nut 23 fixed to the holder 21 to the spline shaft portion 25 of the output shaft 24. Further, the output shaft 24 that is connected to an end portion of the rod 15 of the piston 14 via the bearing 27 is driven in a direct advancing manner by means of the drive of the piston 14, and as a result, force of the linear motion and the rotation force are transmitted to the output shaft 24 as drive force having no relationship with each other. In other words, the rotation force of the output shaft 24 is not transmitted to the piston 14 and thereby the piston 14 performs only a reciprocating movement, and on the contrary, a friction force of a sealing portion of the piston 14 does not affect the output shaft 24 as a resistance as well. Consequently, the sealing portion 14*a* of the piston 14 is not configured to serve as the sealing function of both the linear motion and rotary motion, and thereby the sealing function is fully achieved and the life of the sealing portion 14*a* is elongated.

Further, as is clear from the above-described construction, the rotation unit including holder 21 housed in the inside cylinder tube 12 and the output shaft 24 is constructed such that the same is always placed in the ambient air. Therefore, the lubrication or the like of a sliding bearing portion of the output shaft is not affected by the air pressure as the case that a spline shaft penetrates a cylinder chamber.

In the first embodiment, shown in FIG. 1, the pulley 34 is attached to a portion of the holder 21, which is protruding from the inside cylinder tube 12, and the rotation force is transmitted from the motor 31 via the transmission mechanism including the pulley 34. However, the compound linear motion and rotary actuator may be constructed by means of causing the holder 21 in se to serve as a rotation shaft of various kinds of rotary actuators without causing the aforementioned transmission mechanism to intervene.

Figure 2:
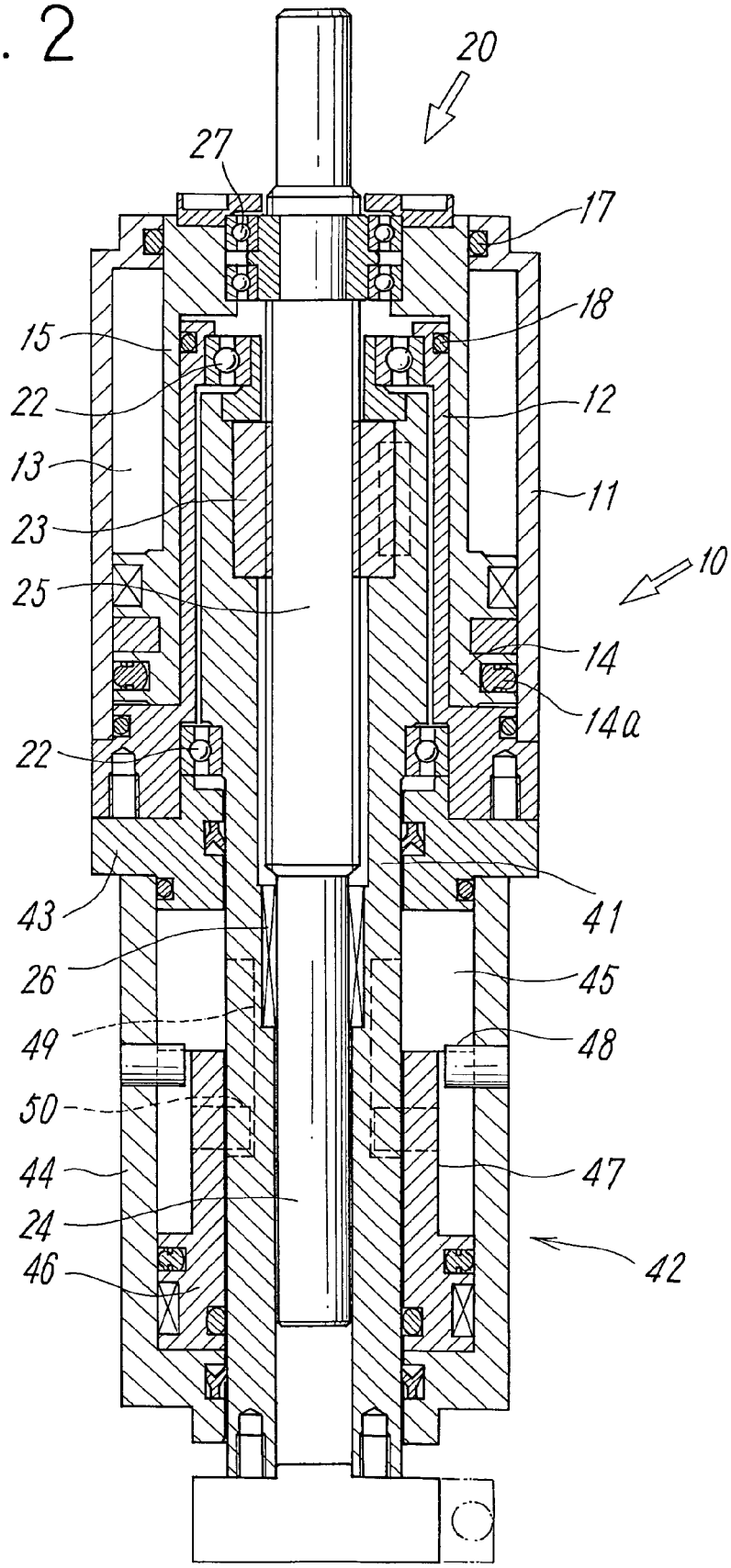
FIG. 2 is a cross-section illustrating a second embodiment of the component linear motion and rotary actuator in accordance with the present invention.

A second embodiment, shown in FIG. 2 describes an example where a screw-type rotary actuator 42 for directly rotationally-driving a holder 41 extending along the output shaft 24 is provided instead of the rotation drive mechanism 30 to rotate the holder 21. Further, the construction of the linear motion unit 10 and the rotary unit 20, and the function thereof are not substantially different from that in the first embodiment except that the rotary actuator 42 is provided in the second embodiment. Therefore, the same numerals denote the same components as those in the first embodiment and only a part which is different from that in the first embodiment will be explained below.

The holder 41 of the rotary unit 20 in the second embodiment penetrates an end lid 43 that closes a lower portion of the inside cylinder tube 12, and the holder 41 further penetrates a casing 44 of the rotary actuator 42 attached to an outer face of the end lid 43 as well, and is led out. In addition, the rotary actuator 42 provided on an outer peripheral portion of the holder 41 forms a second cylinder chamber 45 between the casing 44 and the holder 41, and a piston 46 for the rotation drive is fit into an inner part of the cylinder chamber 45. The piston 46 slides in an axial direction thereof by means of feeding and discharging the pressurized fluid from a feeding-and-discharging port (not shown) into a pressure chamber at both sides of the piston 46 at the cylinder chamber 45. Since a plurality of straight line grooves 47 are formed on an outer face of the piston 46 and a plurality of pins 48 projected on an inside face of the casing 44 are fit into the plurality of straight line grooves 47, the rotation of the piston 46 around the axial line is restrained by means of the pins 48 at a time of the sliding movement thereof.

Further, a helical groove 49 is provided on a surface of the holder 41 that is positioned in the casing 44 and a pin 50 projected on an inner surface of the piston 46 is fit into the helical groove 49. Accordingly, the holder 41 is rotated by means of the pin 50 projected on the inner surface of the piston 46 along with a movement in an axial direction of the piston 46.

Furthermore, the rotation drive mechanism is not limited to the drive mechanism illustrated as the first and the second embodiments, and other mechanism may be employed. For example, rack-type rotary actuator, in which a gear is fabricated around an outer peripheral portion of the holder and a rack being engaged therewith, is moved in a reciprocation manner on a straight line, or the like may be employed.

The invention claimed is:

1. A compound linear motion and rotary actuator:

wherein an inside cylinder tube is concentrically provided in an outside cylinder tube and a piston being driven by means of pressurized fluid is fit into a cylindrically shaped cylinder chamber formed between the inside cylinder tube and the outside cylinder tube in a manner so as to be slidable in an axial direction of the piston, and wherein a holder being rotatably supported by means of a bearing in the inside cylinder tube and being caused to be capable of being rotated by means of a rotation drive mechanism is provided, and an output shaft is inserted into the holder, wherein the output shaft slides in the axial direction whereas the output shaft does not rotate relative to the holder, and wherein the output shaft is connected to a rod of the piston in a manner such that the output shaft integrally moves with the rod of the piston in the axial direction whereas the output shaft is rotatable relative to the rod of the piston by means of a bearing.

2. The compound linear motion and rotary actuator according to claim 1, wherein the holder and the output shaft are connected with each other by means of a spline nut fixed to the holder and a spline shaft portion formed on a part of the output shaft.

3. The compound linear motion and rotary actuator according to claim 2, wherein all of the holder being rotatably supported by the bearing in the inside cylinder tube and the output shaft being inserted in the holder are disposed in an ambient air pressure environment.

4. The compound linear motion and rotary actuator according to claim 3, wherein the rotation drive mechanism for rotating the holder is provided in the outside cylinder tube or the inside cylinder tube, and wherein a transmission mechanism for transmitting a rotation of the rotation drive mechanism to the holder is provided.

5. The compound linear motion and rotary actuator according to claim 3, wherein the rotation drive mechanism for rotating the holder is provided on an axial line of the output shaft to directly rotate the holder.

6. The compound linear motion and rotary actuator according to claim 2, wherein the rotation drive mechanism for rotating the holder is provided in the outside cylinder tube or the inside cylinder tube, and wherein a transmission mechanism for transmitting a rotation of the rotation drive mechanism to the holder is provided.

7. The compound linear motion and rotary actuator according to claim 2, wherein the rotation drive mechanism for rotating the holder is provided on an axial line of the output shaft to directly rotate the holder.

8. The compound linear motion and rotary actuator according to claim 1, wherein all of the holder being rotatably supported by the bearing in the inside cylinder tube and the output shaft being inserted in the holder are disposed in an ambient air pressure environment.

9. The compound linear motion and rotary actuator according to claim 8, wherein the rotation drive mechanism for rotating the holder is provided in the outside cylinder tube or the inside cylinder tube, and wherein a transmission mechanism for transmitting a rotation of the rotation drive mechanism to the holder is provided.

10. The compound linear motion and rotary actuator according to claim 8, wherein the rotation drive mechanism for rotating the holder is provided on an axial line of the output shaft to directly rotate the holder.

11. The compound linear motion and rotary actuator according to claim 1, wherein the rotation drive mechanism for rotating the holder is provided in the outside cylinder tube or the inside cylinder tube, and wherein a transmission mechanism for transmitting a rotation of the rotation drive mechanism to the holder is provided.

12. The compound linear motion and rotary actuator according to claim 1, wherein the rotation drive mechanism for rotating the holder is provided on an axial line of the output shaft to directly rotate the holder.

* * * * *